US010961809B2

(12) United States Patent
Sehsah et al.

(10) Patent No.: US 10,961,809 B2
(45) Date of Patent: Mar. 30, 2021

(54) SYSTEMS AND METHODS FOR SMART WELL BORE CLEAN OUT

(71) Applicant: Saudi Arabian Oil Company, Dhahran (SA)

(72) Inventors: Ossama R. Sehsah, Dhahran (SA); Mahmoud Adnan Alqurashi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 315 days.

(21) Appl. No.: 15/925,285

(22) Filed: Mar. 19, 2018

(65) Prior Publication Data

US 2019/0284905 A1 Sep. 19, 2019

(51) Int. Cl.

| | |
|---|---|
| ***E21B 33/129*** | (2006.01) |
| ***E21B 37/02*** | (2006.01) |
| ***E21B 34/10*** | (2006.01) |
| ***E21B 33/12*** | (2006.01) |
| ***E21B 47/117*** | (2012.01) |

(52) U.S. Cl.

CPC ..... *E21B 33/129* (2013.01); *E21B 33/12* (2013.01); *E21B 34/10* (2013.01); *E21B 37/02* (2013.01); *E21B 47/117* (2020.05)

(58) Field of Classification Search

CPC ..... E21B 21/10; E21B 21/103; E21B 23/01; E21B 23/06; E21B 33/12; E21B 33/128; E21B 33/129; E21B 37/00

See application file for complete search history.

(56) References Cited

U.S. PATENT DOCUMENTS

| | | | | |
|---|---|---|---|---|
| 4,871,018 | A | 10/1989 | Caskey et al. | |
| 5,297,629 | A * | 3/1994 | Barrington | E21B 34/12 166/297 |
| 6,112,811 | A | 9/2000 | Kilgore et al. | |
| 6,227,291 | B1 | 5/2001 | Carmichael et al. | |
| 6,896,064 | B2 | 5/2005 | Howlett et al. | |
| 7,048,055 | B2 | 5/2006 | Hirth | |
| 8,157,012 | B2 | 4/2012 | Frazier | |
| 9,371,711 | B2 | 6/2016 | Foubister et al. | |

(Continued)

FOREIGN PATENT DOCUMENTS

WO 2014100141 A2 6/2014

OTHER PUBLICATIONS

International Search Report and Written Opinion for related PCT application PCT/US2019/022860 dated May 29, 2019.

*Primary Examiner* — Tara Schimpf

(74) *Attorney, Agent, or Firm* — Bracewell LLP; Constance G. Rhebergen; Linda L Morgan

(57) ABSTRACT

Systems and methods for performing operations in a subterranean well with a smart tool include securing the smart tool in line with a tubular string of a well clean out system. The smart tool has a packer, primary slips located downhole of the packer, secondary slips located uphole of the packer, and a circulating valve located uphole of the packer, the circulating value providing a fluid flow path between a central bore of the smart tool and the bore of the subterranean well. The tubular string is moved into the bore of the subterranean well and performing a well clean out operation. The smart tool is releasably anchored in the subterranean well, separating a zone of the bore with the packer, and a well testing operation is performed with the smart tool.

13 Claims, 4 Drawing Sheets

(56) References Cited

U.S. PATENT DOCUMENTS

| | | | | |
|---|---|---|---|---|
| 2006/0102361 | A1* | 5/2006 | Fay | E21B 23/04 166/387 |
| 2011/0162835 | A1 | 7/2011 | Gray | |
| 2012/0175108 | A1* | 7/2012 | Foubister | E21B 33/1294 166/250.01 |
| 2016/0305219 | A1 | 10/2016 | Holloway et al. | |
| 2016/0312582 | A1 | 10/2016 | Ali et al. | |

* cited by examiner

SYSTEMS AND METHODS FOR SMART WELL BORE CLEAN OUT

BACKGROUND OF THE DISCLOSURE

1. Field of the Disclosure

The disclosure relates generally to hydrocarbon development operations in a subterranean well, and more particularly to smart tools for use in a subterranean well during well bore operations.

2. Description of the Related Art

During drilling and completion operations, current technology provides for separate tools to be used for well bore clean out operations and for well pressure testing and well integrity operations. As an example, current well completion operations for monobore completions can require up to four separate trips in the subterranean well.

As an example, a standard procedure for monobore completions can include a dedicated trip to clean the cement inside the liner and scrape the casing for running the permanent packer, a dedicated trip to set a packer to perform a positive pressure test then negative pressure test to confirm the shoe and top of liner integrity, a trip to clean out and clean-out and pickle the production casing, and a dedicated trip to polish the liner.

SUMMARY OF THE DISCLOSURE

Systems and methods of this disclosure provide a smart tool that can be utilized to enhance the well bore clean out process for certain wells. In embodiments of this disclosure, a single trip well bore clean out operation can further include well bore testing at multiple sections of the well by setting, unsetting, and resetting the smart tool independently from the liner top. The smart tool can be used with a variety of well bore clean out tools.

In an embodiment of this disclosure a method for performing operations in a subterranean well with a smart tool includes securing the smart tool in line with a tubular string of a well clean out system. The smart tool has a packer moveable between a retracted position where an outer diameter surface of the packer is spaced apart from an inner surface of a bore of the subterranean well, and an extended position where the outer diameter surface of the packer sealingly engages the inner surface of the bore of the subterranean well. The smart tool also has primary slips located downhole of the packer, the primary slips moveable between a primary unengaged position where a primary gripping surface of the primary slips is spaced apart from the inner surface of the bore, and a primary engaged position where the primary gripping surface of the primary slips grips the inner surface of the bore of the subterranean well. A secondary slips is located uphole of the packer, the secondary slips moveable between a secondary unengaged position where a secondary gripping surface of the secondary slips is spaced apart from the inner surface of the bore, and a secondary engaged position where the secondary gripping surface of the secondary slips grips the inner surface of the bore of the subterranean well. A circulating valve is located uphole of the packer, the circulating valve providing a fluid flow path between a central bore of the smart tool and the bore of the subterranean well. The method further includes moving the tubular string into the bore of the subterranean well and performing a well clean out operation. The smart tool is releasably anchored in the subterranean well, a zone of the bore is separated with the packer, and a well testing operation is performed.

In alternate embodiments, the bore of the subterranean well can include an outer tubing, and the method can further include releasably anchoring the smart tool to an inner diameter surface of the outer tubing. Separating the zone of the bore with the packer can include moving the packer to the extended position and sealingly engaging the inner diameter surface of the outer tubing. Releasably anchoring the smart tool in the subterranean well can include moving the primary slips to the primary engaged position before moving the secondary slips to the secondary engaged position. The method can further include moving the packer to the extended position after moving the primary slips to the primary engaged position and before moving the secondary slips to the secondary engaged position. A slack off weight can be applied to the primary slips before moving the packer to the extended position.

In other alternate embodiments, the method can further include moving the primary slips to the primary engaged position with a first pressure signal and moving the secondary slips to the secondary engaged position with a second pressure signal, where the first pressure signal is independent from the second pressure signal. The well testing operation can include circulating a fluid through the circulating valve. The well testing operation can be a pressure test.

In an alternate embodiment of this disclosure, a system for performing operations in a subterranean well with a smart tool includes the smart tool secured in line with a tubular string of a well clean out system. The smart tool has a packer moveable between a retracted position where an outer diameter surface of the packer is spaced apart from an inner surface of a bore of the subterranean well, and an extended position where the outer diameter surface of the packer sealingly engages the inner surface of the bore of the subterranean well. A primary slips is located downhole of the packer, the primary slips moveable between a primary unengaged position where a primary gripping surface of the primary slips is spaced apart from the inner surface of the bore, and a primary engaged position where the primary gripping surface of the primary slips grips the inner surface of the bore of the subterranean well. A secondary slips is located uphole of the packer, the secondary slips moveable between a secondary unengaged position where a secondary gripping surface of the secondary slips is spaced apart from the inner surface of the bore, and a secondary engaged position where the secondary gripping surface of the secondary slips grips the inner surface of the bore of the subterranean well. A circulating valve is located uphole of the packer, the circulating valve providing a fluid flow path between a central bore of the smart tool and the bore of the subterranean well. The tubular string is located in the bore of the subterranean well and operable to perform a well clean out operation. When releasably anchored in the subterranean well, the smart tool separates a zone of the bore with the packer for performing a well testing operation.

In alternate embodiments of the disclosure, the bore of the subterranean well can include an outer tubing and the smart tool can be releasably anchored to an inner diameter surface of the outer tubing. The packer can sealingly engage the inner diameter surface of the outer tubing in the extended position. The primary slips can support a slack off weight of the tubular string with the packer in the retracted position. A first pressure signal can be operable to move the primary slips to the primary engaged position and a second pressure signal can be operable to move the secondary slips to the secondary engaged position, where the first pressure signal is independent from the second pressure signal. A circulating fluid can circulate through the circulating valve during the well testing operation. The well testing operation can be a pressure test.

BRIEF DESCRIPTION OF THE DRAWINGS

So that the manner in which the previously-recited features, aspects and advantages of the embodiments of this disclosure, as well as others that will become apparent, are attained and can be understood in detail, a more particular description of the disclosure briefly summarized previously may be had by reference to the embodiments that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION OF THE DISCLOSURE

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
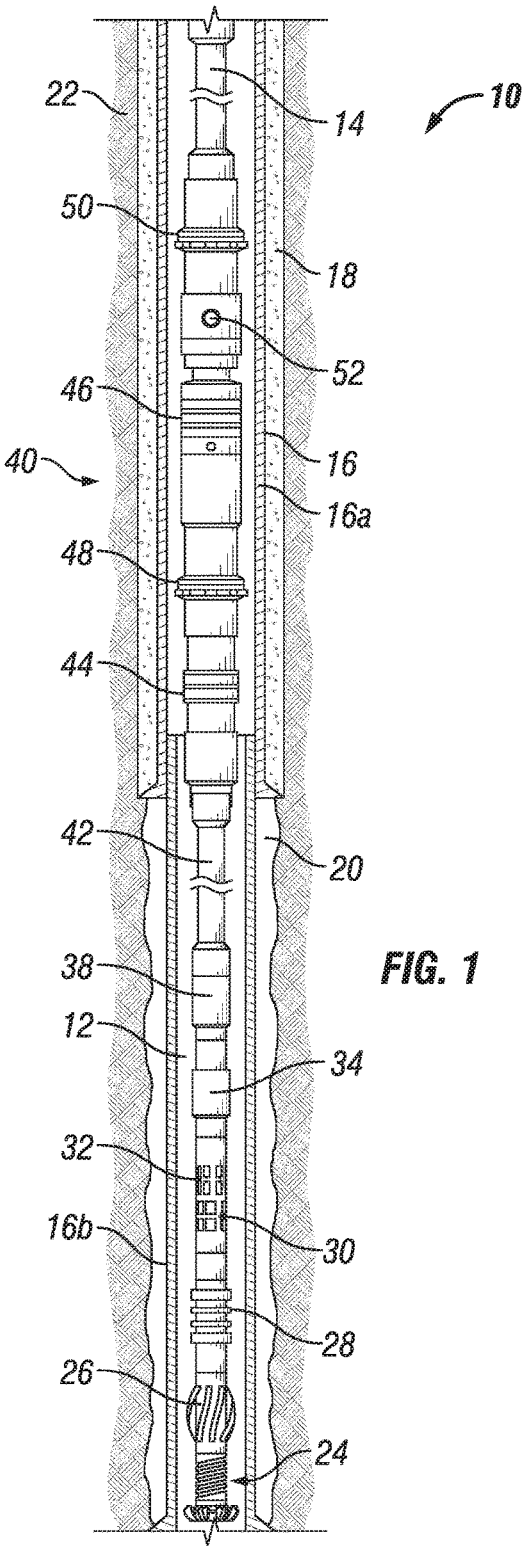
FIG. 1 is a schematic sectional representation of a subterranean well having a smart tool, in accordance with an embodiment of this disclosure, shown with the packer in the retracted position, the primary slips in the primary unengaged position, and the secondary slips in the secondary unengaged position.
Figure 2:
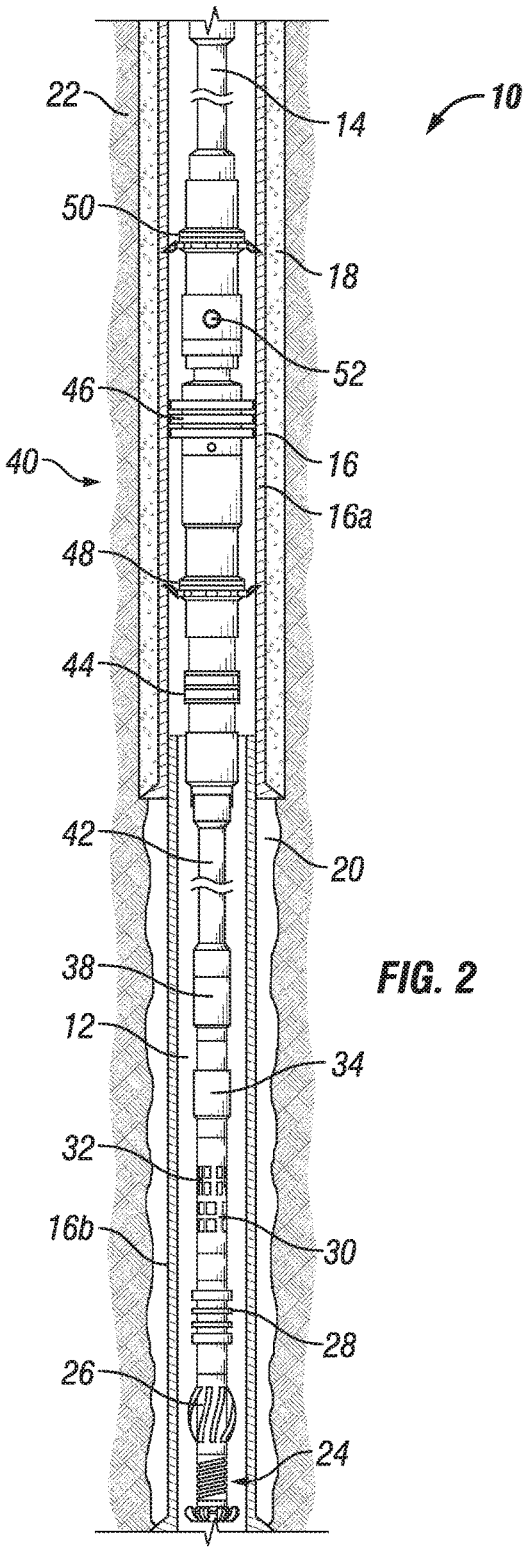
FIG. 2 is a schematic sectional representation of a subterranean well having the smart tool of FIG. 1, shown with the packer in the extended position, the primary slips in the primary engaged position, and the secondary slips in the secondary engaged position.

Looking at FIGS. 1-2, subterranean well 10 extends downwards from a surface of the earth, which can be a ground level surface or a subsea surface. Bore 12 of subterranean well 10 can extended generally vertically relative to the surface. Bore 12 can alternately include portions that extend generally horizontally or in other directions that deviate from generally vertically from the surface. In example embodiments of this disclosure, bore 12 is shown as a bore of an outer tubular member of subterranean well 10. Subterranean well 10 can be a well associated with hydrocarbon development operations, such as a hydrocarbon production well, an injection well, or a water well.

Tubular string 14 extends into bore 12 of subterranean well 10. Tubular string 14 can be, for example, a tool string, a drill string, a casing string, or another elongated member lowered into subterranean well 10. Bore 12 can have an outer tubing 16, such as a casing or liner, into which tubular string 14 is lowered. Cement 18 can be located in the annular space 20 between the outer diameter of any of the outer tubing 16 and the inner diameter of the formation 22 that surrounds subterranean well 10. In alternate embodiments, bore 12 can be encased.

Tubular string 14 can include downhole tools and equipment that are secured in line with joints of tubular string 14. Tubular string 14 can have, for example, a series of known tools that are used for well bore clean out operations. Tubular string 14 can include bit assembly 24 that can be used, for example, for removing cement residue or deposit or a cement plug within outer tubing 16. String mill 26 can also be included in tubular string 14 for breaking down the size of debris generated by bit assembly or debris that is otherwise encountered within bore 12 during clean out operations. Secondary liner scraper 28 can be part of tubular string 14 and used to remove scale and other debris from the inner diameter surface of outer tubing 16.

Tubular string 14 can further include magnet 30 and junk collection tool 32. Magnet 30 can be used to attract and gather any metal debris in bore 12 for removal to the surface. Junk collection tool 32 can be used to gather a variety of material that is located within bore 12 and can also be used to gauge and clean the inner diameter surface of outer tubing 16. Crossover sub 34 can be used as an adaptor to connect the tools of tubular string 14, which may have a first connection diameter, to the remainder of the tubular string 14, which may have a second connection diameter. Drilling jar 38 can be used to deliver an impact load to tubular string 14, such as to unstick tubular string 14 if tubular string 14 becomes stuck. Tubular string 14 can also include primary casing scraper 44. Primary casing scraper 44 can have a larger outer diameter than secondary liner scraper 28 so that secondary liner scraper 28 is sized to scrape scale and other debris from the inner diameter surface of an outer tubing 16 that has a smaller inner diameter and primary casing scraper 44 is sized to scrape scale and other debris from the inner diameter surface of an outer tubing 16 that has a larger inner diameter. As an example, primary casing scraper 44 can be sized to scrape the inner diameter surface of casing 16*a* with a diameter of about nine and five eighths inches or about seven inches and secondary liner scraper 28 can be sized to scrape the inner diameter surface of liner l6*b* with a diameter of about seven to seven and a half inches or about four to four and a half inches. By having both primary casing scraper 44 and secondary liner scraper 28, both a larger diameter casing 16*a* and smaller diameter liner 16*b* can be scraped simultaneously in a single trip.

Figure 3:
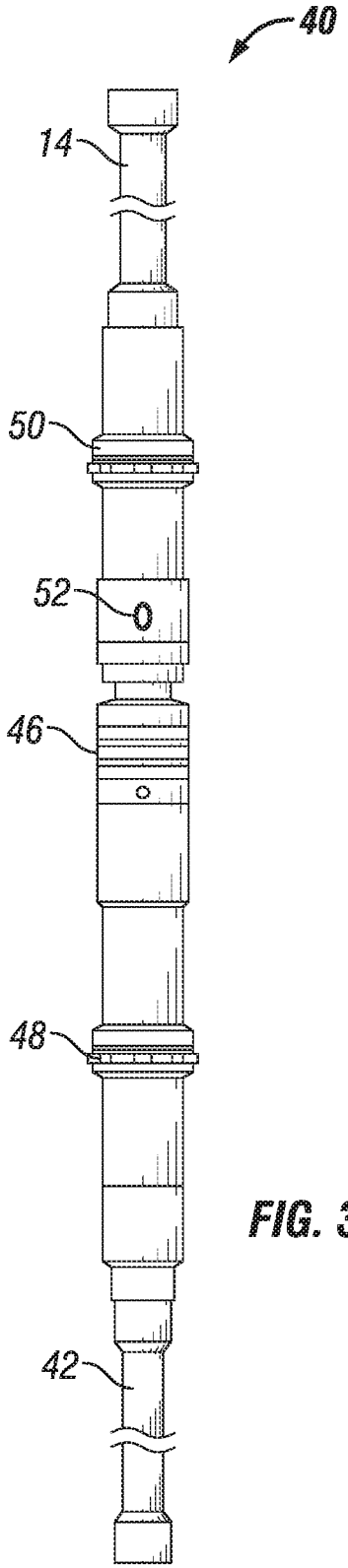
FIG. 3 is a schematic perspective view of a smart tool, in accordance with an embodiment of this disclosure.

Downhole tools and equipment can be spaced from smart tool 40 with a length of intermediate pipe 42. Smart tool 40 can be equipped with pressure signal recognition that allows smart tool 40 to provide multifunction capabilities remotely. Looking at FIG. 3, smart tool 40 includes packer 46. Packer 46 is moveable between a retracted position where an outer diameter surface of packer 46 is spaced apart from the inner surface of bore 12 of subterranean well 10 (FIG. 1), and an extended position where the outer diameter surface of packer 46 sealingly engages the inner surface of bore 12 of subterranean well 10 (FIG. 2) Packer 46 is moveable between the retracted position and the extended position by known means. As an example, a pressure signal from the surface can cause packer 46 to move between the retracted position and the extended position.

Smart tool 40 further includes primary slips 48 that is located downhole of packer 46. Primary slips 48 are moveable between a primary unengaged position where a primary gripping surface of primary slips 48 is spaced apart from the inner surface of bore 12 (FIG. 1), and a primary engaged position where the primary gripping surface of primary slips 48 grips the inner surface of bore 12 of subterranean well 10 (FIG. 2). Primary slips 48 can be moved between the primary unengaged position and the primary engaged position by a first pressure signal. The first pressure signal can be part of a control system that can move primary slips 48 between the primary unengaged position and the primary engaged position by known hydro-mechanical means. As an example, a pressure signal from the surface can cause primary slips 48 to move between the primary unengaged position and the primary engaged position.

Smart tool 40 further includes secondary slips 50 that is located uphole of packer 46. Secondary slips 50 is moveable between a secondary unengaged position where a secondary gripping surface of secondary slips 50 is spaced apart from the inner surface of bore 12 (FIG. 1), and a secondary engaged position where the secondary gripping surface of secondary slips 50 grips the inner surface of bore 12 of subterranean well 10 (FIG. 2). Secondary slips 50 can be moved between the secondary unengaged position and the secondary engaged position by a second pressure signal. The second pressure signal can be part of the control system that can move secondary slips 50 between the secondary unengaged position and the secondary engaged position by known hydro-mechanical means. The first pressure signal is independent and different from the second pressure signal. Having two separate and different pressure signals allows for the control system to distinguish if it is primary slips 48 or secondary slips 50 that is to be moved.

Smart tool 40 also includes circulating valve 52. Circulating valve 52 is located uphole of packer 46. Circulating valve 52 can be located between primary slips 48 and secondary slips 50. Circulating valve 52 provides a fluid flow path between a central bore of smart tool 40 and bore 12 of subterranean well 10. Circulating valve 52 can be used for performing subterranean operations such as well testing operations. Testing operations can include positive or negative pressure testing the integrity of outer tubing 16 of subterranean well 10. Circulating valve 52 can be operated with a third pressure signal of the hydro-mechanical control system.

In an example of operation, smart tool 40 can be secured in line with tubular string 14. Tubular string 14 is moved into bore 12 of subterranean well 10 for performing a well clean out operation with traditional well clean out tools, such as at least one of a bit assembly 24, string mill 26, secondary liner scraper 28, magnet 30, junk collection tool 32, crossover sub 34, drilling jar 38, primary casing scraper 44, or any combination of such well clean out tools. Smart tool 40 is lowered into bore 12 with primary slips 48 in the primary unengaged position, secondary slips 50 in the secondary unengaged position, and packer 46 in the retracted position.

When smart tool 40 has reached an elevation within bore 12 where a well testing operation is to be performed, such as positive or negative pressure testing, to test the integrity of a component of subterranean well 10, primary slips 48 are moved to the primary engaged position where the primary gripping surface of primary slips 48 grips the inner surface of bore 12 of subterranean well 10. The inner surface of bore 12 that is gripped by primary slips 48 can be the inner diameter surface of outer tubing 16, such as the inner diameter surface of larger diameter casing 16*a*. A slack off weight can then be applied to primary slips 48, which can help to set primary slips 48 securely within bore 12.

After primary slips 48 has been moved to the primary engaged position, packer 46 can be moved to the extended position where the outer diameter surface of packer 46 sealingly engages the inner surface of bore 12 of subterranean well 10 to separate a zone of bore 12 for the performance of the well testing operation. Primary slips 48 will act as a base to support tubular string 14 so that packer 46 can maintain a seal within the inner surface of bore 12, which can be the inner diameter surface of outer tubing 16, such as the inner diameter surface of larger diameter casing 16*a*.

After primary slips 48 has been moved to the primary engaged position and packer 46 has been moved to the extended position, secondary slips 50 can be moved to the secondary engaged position where the secondary gripping surface of secondary slips 50 grips the inner surface of bore 12, which can be the inner diameter surface of outer tubing 16, such as the inner diameter surface of larger diameter casing 16*a*.

When conducting a pressure test, circulating valve 52 first remains closed so that there is a single path into and out of bore 12. After completing the positive pressure test, circulating valve 52 can be opened to reverse circulate and achieve an underbalance of pressure in bore 12. Circulating valve 52 can then be closed again to monitor bore 12 for any leaking. After a negative pressure test is conducted, circulating valve 52 can be opened to displace mud, or completion fluid or to clean or pickle outer tubing 16.

For high differential pressure tests, such as test performed in gas wells, deep wells, or other type of well with a pressure differential of up to 10,000 psi, secondary slips 50 will assure that packer 46 maintains a seal within the inner surface of bore 12 throughout the well testing operations and that no leak past packer 46 or accidental deactivation of packer 46 occurs. In addition, secondary slips 50 will eliminate the need to apply a back pressure to reduce the differential pressure effect that can be a cause of failure of e well testing operations of currently available systems.

When the well testing operations are complete, secondary slips 50 can be moved to the secondary unengaged position, packer 46 can be moved to the retracted position, and primary slips 48 can be moved to the primary unengaged position. When moving secondary slips 50 to the secondary unengaged position, an expected slack off weight can be applied to tubular string 14 to avoid damaging smart tool 40. After moving secondary slips 50 to the secondary unengaged position, the slack off weight on tubular string 14 can be changed from a compressive weight to a tension force so that packer 46 can be moved to the retracted position. After primary slips 48 is moved to the primary unengaged position, the clean out operations can continue.

Smart tool 40 can be used for various well testing operations in a singled trip. As an example, smart tool 40 can be used across a number of suspected areas of leaking such as a region adjacent to a differential valve, across a lateral bore, or a region at a top of smaller diameter liner 16*b*, to determine losses or leaks.

Figure 4:
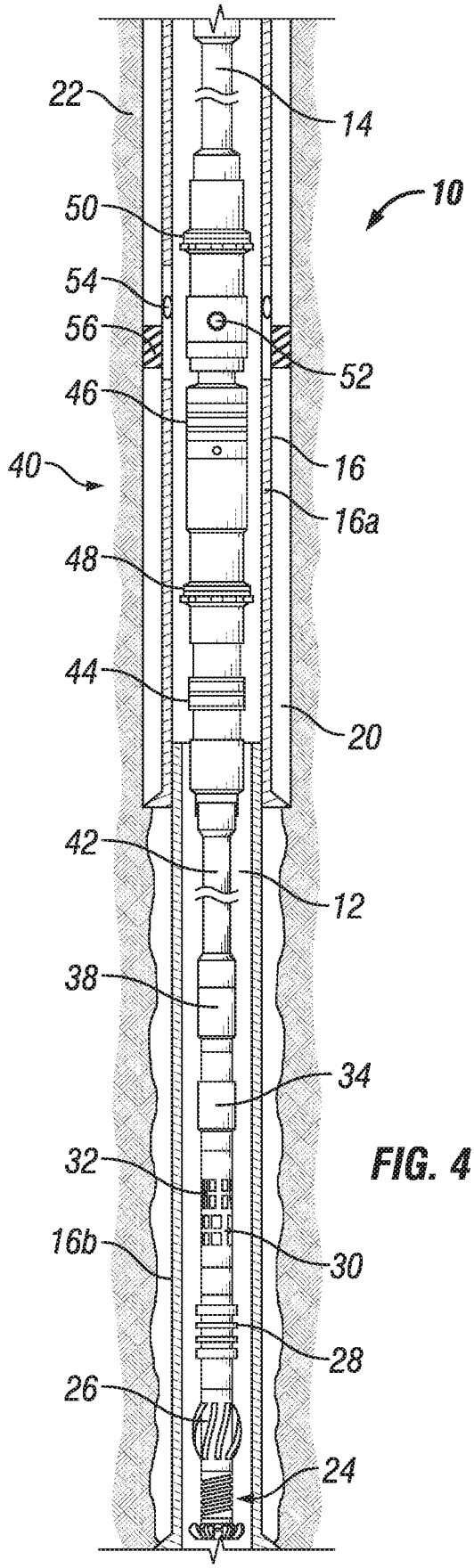
FIG. 4 is a schematic sectional representation of a subterranean well having a smart tool, in accordance with an embodiment of this disclosure, shown with the smart tool located proximate to a differential valve of the outer tubing.

Looking at FIG. 4, when performing well testing operations at a region adjacent to differential valve 54, smart tool 40 can be positioned within bore 12 so that packer 46 is located at an elevation downhole from differential valve packer 56 with circulating valve 52 capable of being in fluid communication with differential valve 54. Differential valve 54 can provide communication between bore 12 and annular space 20 between the outer diameter of any of the outer tubing 16 and the inner diameter of the formation 22 that surrounds subterranean well 10.

Figure 5:
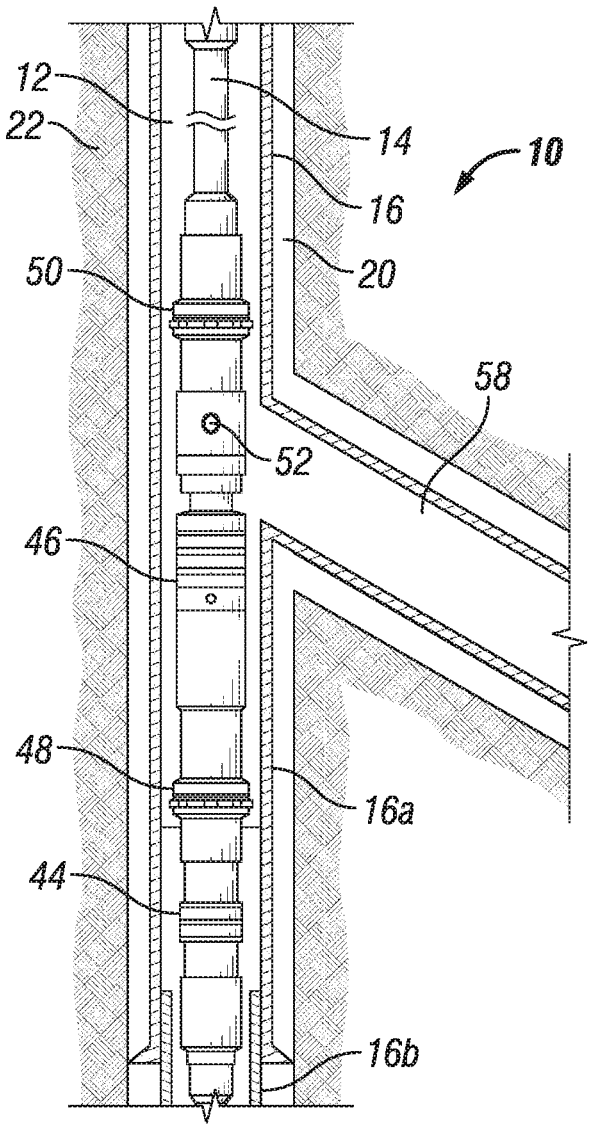
FIG. 5 is a schematic sectional representation of a subterranean well having a smart tool, in accordance with an embodiment of this disclosure, shown with the smart tool located proximate to a lateral bore.

Looking at FIG. 5, smart tool 40 can be used to perform well testing operations across lateral bore 58 to determine if leaks, losses or a water cut is attributable to a particular lateral bore 58. During workover operations, smart tool 40 can determine if the watercut from lateral bore 58 is increasing. When used adjacent to lateral bore 58, smart tool 40 can be positioned within bore 12 so that packer 46 is located at an elevation downhole from lateral bore 58 with circulating valve 52 capable of being in fluid communication with lateral bore 58.

Figure 6:
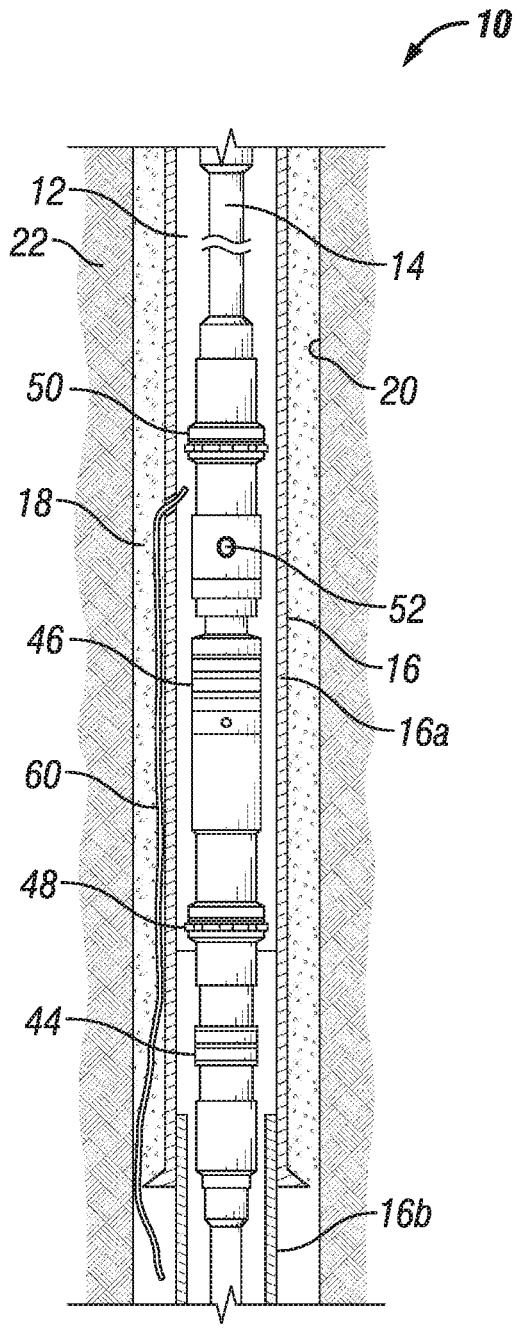
FIG. 6 is a schematic sectional representation of a subterranean well having a smart tool, in accordance with an embodiment of this disclosure, shown with the smart tool located proximate to a leak of an annulus cement.

Looking at FIG. 6, smart tool 40 can be used to test for leaks around a top end of smaller diameter liner 16*b*. In such an embodiment, smart tool 40 can be positioned within bore 12 so that packer 46 is located at an elevation uphole from the top end of smaller diameter liner 16*b* and downhole from the upper end of leak path 60 with circulating valve 52 capable of being in fluid communication with the upper end of leak path 60. In the example of FIG. 6, leak path 60 extends past a bottom end of larger diameter casing 16*a* radially exterior of larger diameter casing 16*a* and through annular space 20 between the outer diameter of lager diameter casing 16*a* and the inner diameter of the formation 22 that surrounds subterranean well 10. Leak path 60 then passes through a crack of larger diameter casing 16*a* uphole of packer 46. The location of the crack through larger diameter casing 16*a* can be identified with smart tool 40 through pressure testing bore 12.

Embodiments of this disclosure can therefore provide systems and methods for testing the integrity of bore 12 of subterranean well 10. Smart tool 40 can be set, unset, and reset multiple times in one trip across many intervals of outer tubing 16. Smart tool 40 is therefore capable of performing multiple well operations in a single trip. Smart tool 40 can be part of tubular string 14 that can also clean cement and other debris from inside larger diameter casing 16*a* and smaller diameter liner 16*b*, perform positive or negative pressure tests, test across differential valve 54 or lateral bore 58, and polish the inner surface of outer tubing 16. Smart tool 40 reduces the time required to perform a series of operations compared to currently available technology. Smart tool 40 includes both primary slips 48 and secondary slips 50 that reduces the risk of deactivation of packer 46 due to differential pressure during well testing operations. The components of smart tool 40 can be activated and deactivated remotely.

Embodiments of the disclosure described, therefore, are well adapted to carry out the objects and attain the ends and advantages mentioned, as well as others that are inherent. While example embodiments of the disclosure have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A method for performing operations in a subterranean well with a smart tool, the method including:

securing the smart tool in line with a tubular string of a well clean out system, the smart tool having:

a packer moveable between a retracted position where an outer diameter surface of the packer is spaced apart from an inner surface of a bore of the subterranean well, and an extended position where the outer diameter surface of the packer sealingly engages the inner surface of the bore of the subterranean well;

a primary slips located downhole of the packer, the primary slips moveable between a primary unengaged position where a primary gripping surface of the primary slips is spaced apart from the inner surface of the bore, and a primary engaged position where the primary gripping surface of the primary slips grips the inner surface of the bore of the subterranean well;

a secondary slips located uphole of the packer, the secondary slips moveable between a secondary unengaged position where a secondary gripping surface of the secondary slips is spaced apart from the inner surface of the bore, and a secondary engaged position where the secondary gripping surface of the secondary slips grips the inner surface of the bore of the subterranean well; and a circulating valve located uphole of the packer, the circulating valve providing a fluid flow path between a central bore of the smart tool and the bore of the subterranean well;

moving the tubular string into the bore of the subterranean well and performing a well clean out operation;

releasably anchoring the smart tool in the subterranean well, separating a zone of the bore with the packer, and performing a well testing operation;

releasably anchoring the smart tool in the subterranean well includes moving the primary slips to the primary engaged position before moving the secondary slips to the secondary engaged position, and moving the packer to the extended position after moving the primary slips to the primary engaged position and before moving the secondary slips to the secondary engaged position.

2. The method of claim 1, where the bore of the subterranean well includes an outer tubing, the method further including releasably anchoring the smart tool to an inner diameter surface of the outer tubing.

3. The method of claim 2, where separating the zone of the bore with the packer includes moving the packer to the extended position and sealingly engaging the inner diameter surface of the outer tubing.

4. The method of claim 1, further including moving the primary slips to the primary engaged position with a first pressure signal and moving the secondary slips to the secondary engaged position with a second pressure signal, where the first pressure signal is independent from the second pressure signal.

5. The method of claim 1, where the well testing operation includes circulating a fluid through the circulating valve.

6. The method of claim 1, where the well testing operation is a pressure test.

7. A system for performing operations in a subterranean well with a smart tool, the system including:

the smart tool secured in line with a tubular string of a well clean out system, the smart tool having:

a packer moveable between a retracted position where an outer diameter surface of the packer is spaced apart from an inner surface of a bore of the subterranean well, and an extended position where the outer diameter surface of the packer sealingly engages the inner surface of the bore of the subterranean well;

a primary slips located downhole of the packer, the primary slips moveable between a primary unengaged position where a primary gripping surface of the primary slips is spaced apart from the inner surface of the bore, and a primary engaged position where the primary gripping surface of the primary slips grips the inner surface of the bore of the subterranean well;

a secondary slips located uphole of the packer, the secondary slips moveable between a secondary unengaged position where a secondary gripping surface of the secondary slips is spaced apart from the inner surface of the bore, and a secondary engaged position where the secondary gripping surface of the secondary slips grips the inner surface of the bore of the subterranean well; and a circulating valve located uphole of the packer, the circulating valve providing a fluid flow path between a central bore of the smart tool and the bore of the subterranean well between the packer and the secondary slips, further including a circulating fluid circulating through the circulating valve during the well testing operation; where the tubular string is located in the bore of the subterranean well and operable to perform a well clean out operation; and when releasably anchored in the subterranean well, the smart tool separates a zone of the bore with the packer for performing a well testing operation.

8. The system of claim 7, where the bore of the subterranean well includes an outer tubing and the smart tool is releasably anchored to an inner diameter surface of the outer tubing.

9. The system of claim 8, where the packer sealingly engages the inner diameter surface of the outer tubing in the extended position.

10. The system of claim 7, where the primary slips supports a slack off weight of the tubular string with the packer in the retracted position.

11. The system of claim 7, further including a first pressure signal operable to move the primary slips to the primary engaged position and a second pressure signal operable to move the secondary slips to the secondary engaged position, where the first pressure signal is independent from the second pressure signal.

12. The system of claim 7, where the well testing operation is a pressure test.

13. A method for performing operations in a subterranean well with a smart tool, the method including:

securing the smart tool in line with a tubular string of a well clean out system, the smart tool having:

a packer moveable between a retracted position where an outer diameter surface of the packer is spaced apart from an inner surface of a bore of the subterranean well, and an extended position where the outer diameter surface of the packer sealingly engages the inner surface of the bore of the subterranean well;

a primary slips located downhole of the packer, the primary slips moveable between a primary unengaged position where a primary gripping surface of the primary slips is spaced apart from the inner surface of the bore, and a primary engaged position where the primary gripping surface of the primary slips grips the inner surface of the bore of the subterranean well;

a secondary slips located uphole of the packer, the secondary slips moveable between a secondary unengaged position where a secondary gripping surface of the secondary slips is spaced apart from the inner surface of the bore, and a secondary engaged position where the secondary gripping surface of the secondary slips grips the inner surface of the bore of the subterranean well; and a circulating valve located uphole of the packer, the circulating valve providing a fluid flow path between a central bore of the smart tool and the bore of the subterranean well between the packer and the secondary slips;

moving the tubular string into the bore of the subterranean well and performing a well clean out operation; and releasably anchoring the smart tool in the subterranean well, separating a zone of the bore with the packer, and performing a well testing operation; where releasably anchoring the smart tool in the subterranean well includes: moving the primary slips to the primary engaged position before moving the secondary slips to the secondary engaged position; moving the packer to the extended position after moving the primary slips to the primary engaged position and before moving the secondary slips to the secondary engaged position; and applying a slack off weight to the primary slips before moving the packer to the extended position.

* * * * *